US005778742A

United States Patent [19]

Stuart

[11] Patent Number: 5,778,742

[45] Date of Patent: Jul. 14, 1998

[54] HYDRAULIC BACKUP TONG

[75] Inventor: Randolph L. Stuart, Odessa, Tex.

[73] Assignee: Eckel Manufacturing Company, Inc., Odessa, Tex.

[21] Appl. No.: 887,526

[22] Filed: Jul. 3, 1997

Related U.S. Application Data

[63] Continuation of Ser. No. 554,518, Nov. 7, 1995, abandoned.

[51] Int. Cl.[6] ..... B25B 13/50

[52] U.S. Cl. ..... 81/57.34; 81/57.33

[58] Field of Search ..... 81/57.33, 57.34, 81/57.36; 269/25, 27, 32, 268

[56] References Cited

U.S. PATENT DOCUMENTS

| | | | |
|---|---|---|---|
| 2,668,689 | 2/1954 | Cormany . | |
| 2,737,839 | 3/1956 | Paget . | |
| 2,760,392 | 8/1956 | Paget . | |
| 3,507,174 | 4/1970 | Dickmann . | |
| 3,518,903 | 7/1970 | Ham et al. . | |
| 4,200,010 | 4/1980 | Hewitt | 81/57.34 |
| 4,290,304 | 9/1981 | Eckel . | |
| 4,402,239 | 9/1983 | Mooney | 81/57.34 |
| 4,515,045 | 5/1985 | Gnatchenko et al. | 81/57.34 |
| 4,574,664 | 3/1986 | Curry . | |
| 4,649,777 | 3/1987 | Buck . | |
| 4,732,061 | 3/1988 | Dinsdale | 81/57.34 |
| 5,201,501 | 4/1993 | Fassler | 269/32 |
| 5,259,275 | 11/1993 | Schulze-Beckinghausen | 81/57.34 |

OTHER PUBLICATIONS

Published 1981 Drawing "5½ R Hydraulic Backup Exploded Assembly".

*Primary Examiner*—David A. Scherbel
*Assistant Examiner*—Joni B. Danganan
*Attorney, Agent, or Firm*—Browning Bushman

[57] ABSTRACT

The powered backup tong assembly 10 includes a planar support plate 14, a pair of hydraulically powered cylinders 16, 18, a pair of link arms 20, 22, and heads 24, 26, and 30 for gripping engagement with the oilfield tubular. The powered backup tong frame includes an open throat 28 for laterally moving the power tong on and off the tubular member. A pair of rear ears 32, 34 each extending laterally outward from a centerline 12 of the plate 14 facilitate mounting the pair of hydraulically powered cylinders 16, 18 laterally outward of the support plate 14. The opposing heads 24, 26 are each pivotally connected to a respective pivot arm 20, 22, and the head 30 is mounted directly to support plate 14. The power tong is relatively simple and lightweight, and is highly reliable.

20 Claims, 3 Drawing Sheets

HYDRAULIC BACKUP TONG

This is a continuation of application Ser. No. 08/554,518 filed on Nov. 7, 1995 now abandoned.

FIELD OF THE INVENTION

The present invention relates to a backup tong conventionally used with a power tong to make up or break apart oilfield tubular members. More particularly, this invention relates to a relatively simple yet highly reliable backup tong which may be used to grip and secure a tubular member against rotation.

BACKGROUND OF THE INVENTION

Powered rotary tongs are commonly used to rotate an upper tubular member, e.g., a casing, drill pipe, or tubing, relative to a similar stationary lower tubular member, and thereby threadably make up or break apart a threaded connection. When employing such powered rotary tongs, it is generally desirable to prevent the lower tubular member from rotation that might otherwise occur when high torque is applied to the upper tubular member by the rotary tong, particularly during the initial break up or final make up operations. Since the lower tubular member is then stationary, it may be used as a base or reference to prevent rotation of the powered rotary tong body, such that the powered rotary tong need be "tied off" to another stationary object.

Both manual and powered backup tongs have been utilized to grip and prevent rotation of the lower tubular. Manual backup tongs general require additional operator intervention, and may be unable to successfully grip the lower tubular to prevent rotation when the upper tubular is subject to high torque. Also, powered backup tongs may conventionally be used as the base or reference to prevent rotation of the powered rotary tong. A stinger or other structure rigidly fixed to the rotary tong body may extend downward for engagement with the stationary backup tong. A load cell acting between the stinger and the backup tong may then conveniently output the torque applied by the rotary tong to the tubular member. Accordingly, powered backup tongs are generally preferred by tong operators. Closed-throat backup tongs have a frame which fully encircles the tubular member, and thus cannot be laterally put on and taken off a section of pipe. Accordingly, open-throat backup tongs are preferred by operators compared to closed-throat backup tongs.

An early version of the backup tong utilizing a wedge for forcing each of multiple dies into gripping engagement with a pipe is disclosed in U.S. Pat. No. 2,668,689. One type of rotary tong and backup tong is disclosed in U.S. Pat. No. 2,737,839, and another combination rotary tong and backup tong is disclosed in U.S. Pat. No. 2,760,392. U.S. Pat. No. 3,507,174 discloses a backup tong with heads which are moved radially into gripping engagement with a pipe upon actuation of a hydraulic cylinder. A similar backup tong is disclosed in U.S. Pat. No. 3,518,903.

U.S. Pat. No. 4,049,777 discloses a backup tong with three heads each movable radially into gripping engagement with a pipe, with each head being powered by a respective hydraulic cylinder. A backup tong with a rotatable cage plate is disclosed in U.S. Pat. No. 4,290,304. U.S. Pat. No. 4,574,664 discloses a backup tong with a pair of hydraulic cylinders for rotating a cage plate assembly during make up and break out of an oilfield tubular joint.

Another prior art backup tong included a pair of hydraulic cylinders each mounted between upper and lower tong plates. A pair of pivot arms were each connected to a cross brace, which was also positioned between the upper and lower tong plates. A pair of gripping heads were each confined by guides to move radially inward and outward with respect to the tubular to be gripped, and were also spaced between the upper and lower tong plates. Activation of the cylinders rotates the pivot arms with respect to the cross brace, thereby pressing the heads into gripping engagement with the tubular.

Prior art powered backup tongs are relatively complex, and most backup tongs are costly to manufacture and maintain. Backup tongs typically are much heavier than desired by the oilfield operator. Some backup tongs require movement of one or more parts to control the tong between a make up and a break out operation, thereby costing valuable rig time.

The disadvantages of the prior art are overcome by the present invention. An improved powered backup tong is hereinafter disclosed which is relatively simple, is lightweight, and is easily and reliably operated.

SUMMARY OF THE INVENTION

The powered backup tong according to the present invention preferably includes a single support plate which lies in a plane generally perpendicular to the centerline of tubular member to be gripped by the backup tong. The tong support plate is of the open throat variety so that the backup tong may be laterally put on and taken off the oilfield tubular, preferably in conjunction with the powered rotary tong. A pair of hydraulic cylinders are each pivotally connected at one end to the support plate, and are positioned laterally outward from the support plate. A respective pair of pivot arms are also pivotally connected to the support plate. The rod end of each hydraulic cylinder is also pivotally connected to a respective pivot arm. A head is also pivotally mounted to a respective pivot arm, such that upon actuation of the hydraulic cylinder, the head is moved into gripping engagement with the oilfield tubular. A third head is preferably secured to the support plate in a position opposite the open throat.

It is an object of the present invention to provide an improved powered backup tong which is highly reliable and is lightweight. It is a related object of the present invention to provide a backup tong which has a low manufacturing and maintenance cost. These objections are achieved in part by providing a powered backup tong including a single support plate, thereby reducing the weight of the backup tong.

It is a feature of the invention that the backup tong includes a pair of hydraulic cylinders which are each pivotally connected to the support plate and are positioned laterally outward from the support plate. Each hydraulic cylinder in turn is also pivotally connected to a pivot arm, which is also pivotably connected to the same support plate. Actuation of the hydraulic cylinders simultaneously moves the pivot arms and the two laterally opposing heads each connected to a respective pivot arm into gripping engagement with the oilfield tubular. The third head is preferably mounted to the support plate and is positioned opposite the open throat of the backup tong.

It is an advantage of the powered backup tong that a valve lever may control the supply of fluid pressure to the hydraulic cylinders, and that other components need not be manipulated between make up and break out operations. It is also an advantage of the present invention that the tong may be used with existing power tongs.

These and further objects, features, and advantages of the present invention will become apparent from the following detailed description, wherein reference is made to the figures in the accompanying drawings.

DETAILED DESCRIPTION OF THE PREFERRED EMBODIMENTS

Figure 1:
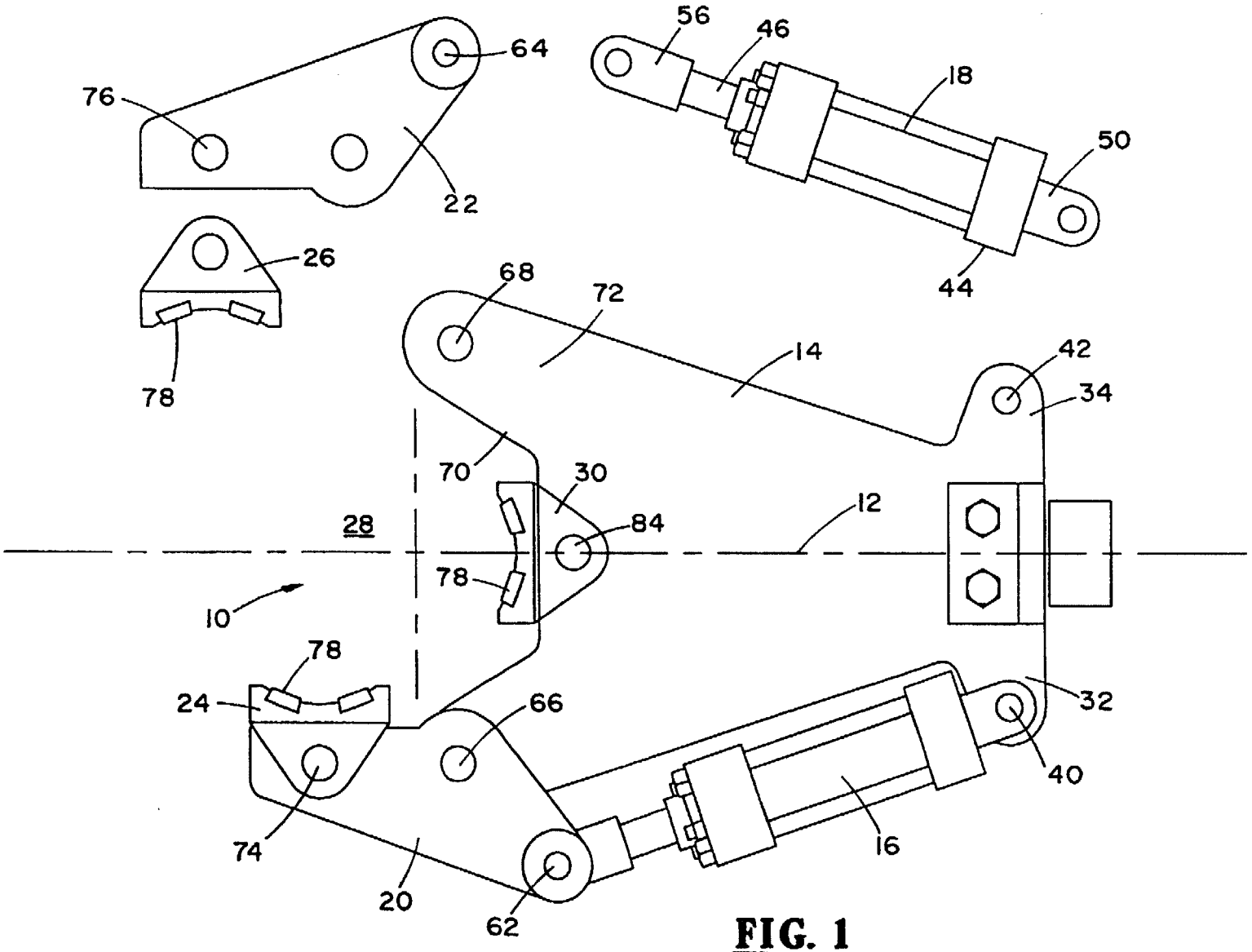
FIG. 1 is a top view of a partially disassembled backup tong according to the present invention.

FIG. 1 illustrates a suitable powered backup tong 10 according to the present invention. The tong is preferably symmetrical about centerline 12, and includes a single tong plate 14, a pair of hydraulic cylinders 16, 18, a pair of pivot arms 20, 22, and a pair of gripping heads 24, 26. Those skilled in the art will appreciate that the cylinder 18, the pivot arm 22, and the gripping head 26 above the centerline 12 are depicted as being removed from the assembly 10 to more clearly depict these components. The tong is preferably symmetrical about centerline 12, and the corresponding components mounted on the support plate 14 are depicted below centerline 12 in FIG. 1. A third head 30 is mounted directly to the support plate and is positioned along the centerline 12.

The powered backup tong 10 may be used in conjunction with a powered rotary tong to make up and break apart joints of an oilfield tubular, such as pipe. Those skilled in the art will appreciate that the backup tong of the present invention includes an open throat 28 so that the tong may be laterally put on and taken off the oilfield tubular, preferably in conjunction with a powered rotary tong (not shown) positioned immediately above the backup tong. The terms "upper" and "lower" are relative terms used below to describe the conventional arrangement of components at a rig site. The powered backup tong of the present invention could be utilized, however, to make up and break apart joints of tubulars in a horizontal position, in which case the equipment would be conventionally referred to as a bucking machine.

The backup tong components are each supported directly or indirectly on support plate 14, which is a planar plate which is positioned substantially perpendicular to the centerline of the tubular during the make up and break out operations. The support plate 14 thus forms the frame of a backup tong, which normally consists of an upper plate, a lower plate, side and end plates, and securing members interconnecting these plates. Only a single plate 14 is utilized to significantly reduce the cost and weight of the backup tong according to the present invention. The support plate 14 includes ears 32 and 34 which each extend laterally outward from the centerline 12 of the plate with respect to the body of the support plate adjacent the ears 32, 34. As shown in FIG. 1, the ears 32 and 34 facilitate mounting of the hydraulic cylinder assemblies 16, 18 laterally outward from the support plate. Plate 14 has an upper planar surface 36 and a lower planar surface 38 (see FIG. 3) which define a respective upper plane and a lower plane each substantially perpendicular to the centerline of the tubular to be gripped by the backup tong.

The fluid powered cylinder assemblies 16, 18 are each pivotally mounted to a respective ear 32, 34 of the support plate 14 by a suitable pin 40 passing through a respective aperture 42 in the support plate. The cylinder end 44 of each cylinder assembly is preferably adjacent the rear end of the backup tong and the rod end 46 of each cylinder assembly is adjacent the front end of the backup tong to more evenly distribute the weight of the backup tong during its operation. As depicted, the cylinder assemblies are continually on opposing sides of the centerline 12 and are laterally outward from the support plate 14. Each cylinder assembly is positioned at least partially between the upper and lower planes defined by the support plate surfaces 36 and 38. Each cylinder assembly extends and retracts in a conventional manner along a cylinder axis 48 which is substantially parallel to both the surfaces 36 and 38. Each cylinder axis 48 is preferably positioned between the surfaces 36 and 38, and ideally is positioned substantially equally between surfaces 36 and 38 so that the center of the cylinder assemblies is substantially horizontal with the center of the support plate.

The cylinder end 44 of each hydraulic cylinder assembly 16, 18 includes a yoke 50 which includes an upper mounting plate 52 and a lower mounting plate 54. The plates 52 and 54 are spaced apart such that the respective ear 32, 34 passes between these plates to maintain each cylinder assembly substantially within the plane of the support plate 14 while allowing each cylinder assembly to pivot during operation of the backup tong. In the FIGS. 1 and 2 embodiment, a similar yoke 56 with upper and lower plates 58 is provided at the rod end 46 of each cylinder assembly 16, 18. The pivot arm 20, 22 is connected to the rod end of each cylinder assembly 16, 18 by pin 62 which passes through a respective aperture 64 in the pivot arm.

Each pivot arm 20, 22 is pivotally mounted to the support plate 14 by pin 66 passing through a respective aperture 68 in the support plate. The plate 14 laterally widens in the direction approaching throat 28, with the cutout 70 forming the open throat 28. Each pivot arm 20, 22 is mounted on a projecting member 72 of the plate 14 which projects slightly laterally outward and toward the front end of the tong as shown in FIG. 1. Each plate 20, 22 is preferably also a substantially planar member which, as depicted in the figures, is mounted above the plate 14. The lower surface of each pivot arm thus slidably engages the upper surface 36 of the support plate 14 during actuation of the hydraulic cylinder assemblies.

Heads 24 and 26 are pivotally mounted to a respective pivot arm 20, 22 by pin 74 passing through aperture 76 in the pivot arm. Only a slight amount of rotation (only a few degrees) is required between the head and the respective pivot arm, although this slight rotation is important for properly engaging the dies on the head to securely grip the tubular without damaging the tubular. The rear end of each head 24, 26 is provided with an upper connection plate 80 and lower connection plate 82 separated by a planar spacing, with the spacing between the connection plates receiving the respective pivot arm 20, 22 in a manner described previously.

A third head 30 may be similarly configured, and its respective upper and lower connection plates receiving plate 14 therebetween. The third head 30 is thus supported directly on the plate 14 by pin 84 passing through an aperture in the plate 14. A slight amount of "play" between the third head 30 and the plate 14 may be desired, although very little pivotal rotation and very little movement between the head 30 and the plate 14 is required. Those skilled in the art will appreciate that each head is provided with conventional dies 78, and circumferentially longer or "wrap around" dies may be utilized on each head.

Figure 2:
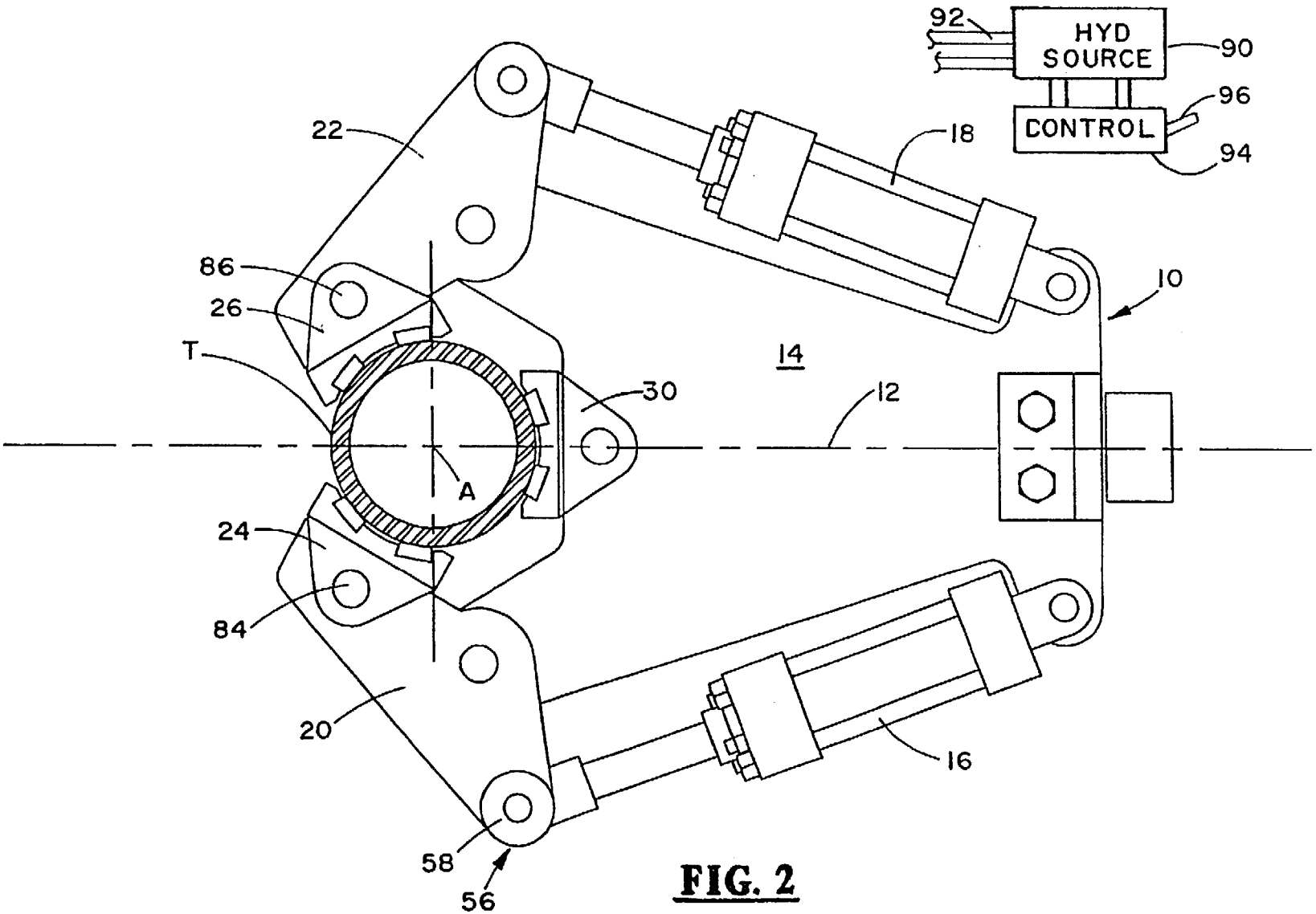
FIG. 2 illustrates the backup tong according to the present invention with the tong actuated for gripping engagement with an oilfield tubular.

FIG. 2 depicts the power tong 10 when actuated such that each of the heads 24, 26 and 30 are in engagement with the tubular T. The tubular T has a vertical axis A which is perpendicular to the horizontal centerline 12 of the tong, as shown. A conventional hydraulic power source 90 transmits fluid pressure through flexible flow lines 92 to simultaneously extend and retract each of the hydraulic cylinder assemblies 16, 18. Operator control 94 with a single level handle 96 may be used to direct fluid to the rod or cylinder end of each cylinder assembly, or to maintain fluid pressure on the cylinder assemblies, as desired, during the make up or break out operations.

The symmetrical centerline of the heads 24 and 26 passes through the head axis 84 and 86, respectively, which is the axis about which each head pivots with respect to pivot arm 20, 22. The components of the backup tong are arranged such that the three heads 24, 26 and 30 uniformly grip the tubular T. To this end, the tong components are arranged such that the circumferential spacing between the head axes 84 and 86 is less than 140°, and preferably is less than 130°, when the heads grippingly engage the tubular T such that the tubular is uniformly gripped without being crushed or damaged. Ideally, the heads 24, 26 and 30 are preferably circumferentially spaced approximately 120° about the tubular T when the backup tong is actuated such that each of the three heads uniformly engages the tubular.

The hydraulic cylinder assemblies 16, 18 of the backup tong 10 are preferably powered by a conventional hydraulic fluid source. Those skilled in the art will understand that the cylinder assemblies could be pneumatically powered. As previously indicated, the cylinder end of each assembly 16, 18 is preferably mounted adjacent the rear end of the backup tong and the rod end adjacent the front end of the backup tong. The cylinder assemblies could be reversed, however, such that the rod end of each cylinder assembly was mounted to a respective ear 32, 34 and the cylinder end mounted to a respective pivot arm 20, 22. Also, those skilled in the art will appreciate that the pivot arms 20, 22 may be provided with a yoke portion such that each pivot arm has spaced apart upper and lower plates for receiving a single plate on the end of a cylinder assembly 16, 18 therebetween.

Figure 3:
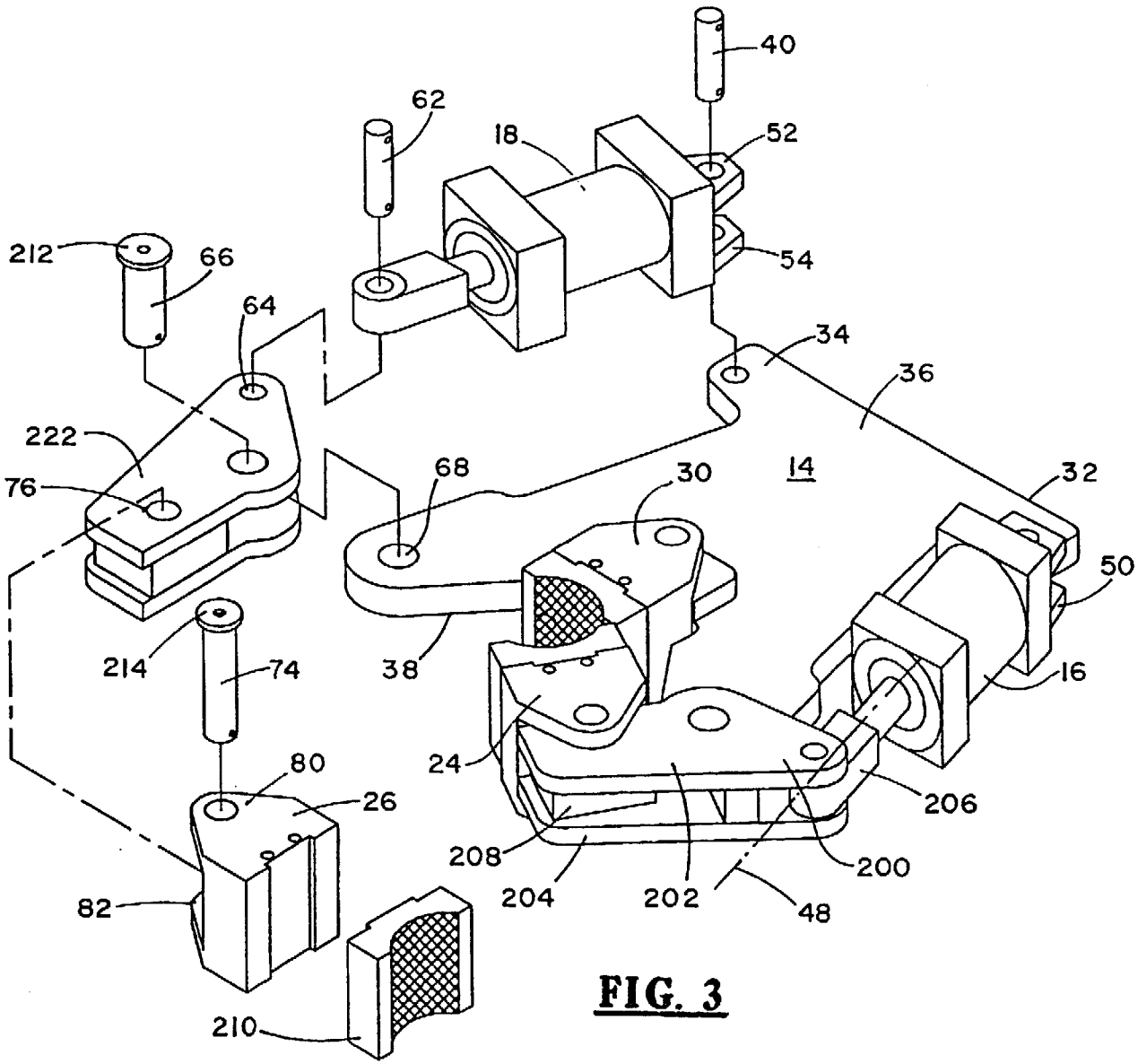
FIG. 3 is a partially disassembled pictorial view of an alternate embodiment of the backup tong, illustrating the structural connections between the support plate and a hydraulic cylinder and pivot arm.

FIG. 3 depicts pivot arms 200, 222 that each include an upper plate 202 and a lower plate 204, with the spacing between the plates being slightly greater than end 206 on cylinder assembly 16. One or more blocks 208 may cooperate with end 206 and plate 14 to maintain the proper uniform spacing between the plates 202 and 204. An advantage of utilizing upper and lower pivot arm plates is that the significant forces applied to the left-side and right-side pivot arms may be maintained within the plane of the plate 14. Accordingly, none of the pins 62, 66 and 74 are subject to twisting or bending forces. As shown in FIG. 3, the heads 24 and 26 each include upper and lower flanges 80 and 82, respectively, for fitting above and below the respective pivot arm plates. Again, no twisting or bending forces are applied to the head pins 74. FIG. 3 also depicts circumferentially longer wrap around dies 210 for mounting at the front end of each head 24, 26 and 30. FIG. 3 also depicts pins 66 and 74 with cap heads 212 and 214, respectively. The pins 40 and 62 may be retained in position between the plate 74 and either single plate 220 or upper and lower plates 202, 204 by a set screw or other conventional members.

During operation, it may be initially presumed that the backup tong is laterally positioned away from the tubular T and that the hydraulic cylinder assemblies are retracted such that the pivot arms 20, 22 are open, as shown in FIG. 1. Backup tong 10 may be then laterally moved to engagement with the tubular T, with the tubular passing through the throat 28 of the backup tong until the tubular engages the third head 30. The operator may then activate the control 94 to cause fluid pressure to simultaneously extend cylinder assemblies 16, 18, thereby pivoting the respective pivot arms 20 and 22 and bringing the heads 24 and 26 into engagement with the tubular T, as shown in FIG. 2. After the make up or break out operation is complete, the operator may again actuate the lever 96 to retract the assemblies 16, 18, thereby allowing the backup tong to move laterally off the tubular T.

The backup tong as discussed above is not shown with a stinger for rotatably interconnecting the power tong and backup tong. Those skilled in the art will appreciate that a stinger or other structural member may be connected to either the rotary tong or the backup tong, and may extend vertically for engagement with the other of the rotary tong and backup tong. Once the backup tong 10 has gripped the lower tubular T, rotation of the frame of the rotary tong may thus prevented by engagement of the stinger with the backup tong in a conventional manner. Also, a load cell or other pressure transducer may be used to measure the torque exerted by the stinger, and thereby determine the torque of the power tong applied to the tubular during the make up or break out operation.

The foregoing disclosure and description of the invention are illustrative and explanatory, and various changes in the components as well as in the method of operating the backup tong may be made within the scope of the invention, which is defined by the claims.

What is claimed is:

1. A powered backup tong for securing a tubular member against axial rotation in response to rotation of another tubular member by a pipe-rotating device, the backup tong comprising:

a single planar support plate having an open throat for receiving the tubular member, an upper planar surface defining an upper plane and a lower planar surface defining a lower plane, and a plate centerline extending through the open throat;

first and second fluid powered cylinder assemblies each pivotally mounted at one end to the planar support plate and having an opposing end, the first and second cylinder assemblies each mounted on opposing sides of the plate centerline and positioned laterally outwardly from the support plate;

first and second pivot arms each pivotally mounted to the support plate on opposing sides of the plate centerline;

the opposing end of each of the first and second cylinder assemblies pivotally connected to a respective pivot arm;

first and second heads each movable in response to movement of a respective pivot arm for gripping engagement with the tubular member; and each of the first and second cylinder assemblies extends and retracts along a cylinder axis positioned between the upper plane and the lower plane.

2. The powered backup tong as defined in claim 1, further comprising:

a third head fixedly mounted on the support plate and positioned along the plate centerline.

3. The powered backup tong as defined in claim 1, wherein each of the first and second heads is pivotally connected to the respective pivot arm.

4. The powered backup tong as defined in claim 3, wherein each of the first and second heads is pivotally mounted to the respective first and second pivot arm to rotate about a respective first and second head axis, and the first and second head axes are circumferentially spaced less than 130° apart when the first and second heads each engage the tubular member.

5. The powered backup tong as defined in claim 1, wherein the support plate includes laterally outwardly extending ears for pivotally mounting the first and second cylinder assemblies to the support plate.

6. The powered backup tong as defined in claim 1, wherein each of the first and second heads includes an upper connection plate and a lower connection plate, and the respective first and second pivot arm is fitted between and pivotably connected to both the upper and the lower connection plates.

7. The powered backup tong as defined in claim 1, wherein a rear end of each of the first and second cylinder assemblies includes an upper mounting plate and a lower mounting plate, and the support plate is positioned between the upper and the lower mounting plates.

8. The backup tong as defined in claim 1, wherein the cylinder axis of each of the first and second fluid powered cylinder assemblies is spaced substantial midway between the upper plane and lower plane.

9. A powered backup tong securing a tubular member against axial rotation in response to rotation of another tubular member by a powered rotary tong, the backup tong comprising:

a single planar support plate having an open throat for receiving the tubular member, an upper planar surface defining an upper plane and a lower planar surface defining a lower plane, and a plate centerline extending through the open throat;

first and second fluid powered cylinder assemblies each pivotally mounted at one end of the planar support plate and having an opposing end, the first and second cylinder assemblies each mounted on opposing sides of the plate centerline;

first and second pivot arms each pivotally mounted to the support plate on opposing sides of the plate centerline;

the opposing end of each of the first and second cylinder assemblies pivotally connected to a respective pivot arm;

first and second heads each pivotally connected to a respective pivot arm for gripping engagement with the tubular member;

a third head mounted on the support plate and positioned along the plate centerline; and each of the first and second cylinder assemblies extends and retracts along a cylinder axis positioned between the upper plane and the lower plane.

10. The powered backup tong as defined in claim 9, wherein each of the first and second heads is pivotably connected to the respective first and second pivot arm to rotate about a respective first and second head axis, and the first and second head axes are circumferentially spaced less than 130° apart when the first and second heads each engage the tubular member.

11. The powered backup tong as defined in claim 9, wherein the support plate includes laterally outwardly extending ears for pivotably mounting the first and second cylinder assemblies to the support plate laterally outwardly from the support plate.

12. The powered backup tong as defined in claim 9, wherein each of the first and second pivot arms includes an upper pivot plate and a lower pivot plate, and the opposing end of the respective first and second fluid powered cylinder is fitted between the upper and the lower pivot plates.

13. The backup tong as defined in claim 9, wherein the cylinder axis of each of the first and second fluid powered cylinder assemblies is spaced substantial midway between the upper plane and lower plane.

14. A backup tong for securing a tubular member against axial rotation, the backup tong comprising:

a single planar support plate having an open throat for receiving the tubular member and a plate centerline extending through the upper throat, the support plate having an upper planar surface defining an upper plane and a lower planar surface defining a lower plane;

first and second fluid powered cylinder assemblies each pivotally mounted at one end to the planar support plate and having an opposing end, the first and second cylinder assemblies each mounted on opposing sides of the plate centerline and positioned laterally outwardly from the plate, each of the first and second cylinder assemblies extends and retracts along a cylinder axis positioned between the upper plane and the lower plane and extendable and retractable along the cylinder axis substantially parallel to the upper plane;

first and second pivot arms each pivotally mounted to the support plate on opposing sides of the plate centerline;

the opposing end of each of the first and second cylinder assemblies pivotally connected to a respective pivot arm; and first and second heads each supported on a respective pivot arm for gripping engagement with the tubular member.

15. The powered backup tong as defined in claim 14, wherein a rear end of each of the first and second cylinder assemblies includes an upper mounting plate and a lower mounting plate, and the support plate is positioned between the upper and lower mounting plates.

16. The powered backup tong as defined in claim 14, wherein each of the first and second heads is pivotally connected to the respective first and second pivot arms to rotate about a respective first and second head axis, and the first and second head axes are circumferentially spaced less than 130° apart when the first and second heads each engage the tubular member.

17. The powered backup tong as defined in claim 16, further comprising:

a third head fixedly mounted on the support plate and positioned along the plate centerline.

18. The powered backup tong as defined in claim 17, wherein the third head includes an upper connection plate and a lower connection plate, and the support plate is fitted between the upper and the lower connection plates.

19. The powered backup tong as defined in claim 14, wherein the support plate includes laterally outwardly extending ears for pivotably mounting the first and second cylinder assemblies to the support plate.

20. The powered backup tong as defined in claim 14, wherein each of the first and second heads include an upper connection plate and a lower connection plate, and the respective first and second pivot arm is fitted between and pivotably connected to both the upper and the lower connection plates.

* * * * *